United States Patent [19]

Lansberry

[11] 4,323,250

[45] Apr. 6, 1982

[54] TARGET GAME

[76] Inventor: Delbert B. Lansberry, 211 S. Trask, Tampa, Fla. 33609

[21] Appl. No.: 970,452

[22] Filed: Dec. 18, 1978

[51] Int. Cl.[3] ..... A63F 7/00; A63B 63/04

[52] U.S. Cl. ..... 273/400; 273/411; 273/DIG. 21; 273/352; 206/315 B

[58] Field of Search ..... 273/95 R, 105 R, 127 R, 273/123 R, 124 R, 125 R, 102 R, 95 H, 31, 177 R, 181 A, 181 R, 178 B, 177 A, 400, 411, DIG. 21, 352

[56] References Cited

U.S. PATENT DOCUMENTS

| | | | |
|---|---|---|---|
| 922,717 | 5/1909 | Parker | 273/105 R |
| 1,072,954 | 9/1913 | Junn | 273/105 R |
| 1,248,970 | 12/1917 | Wilson-Hughes | 273/95 R |
| 1,329,291 | 1/1920 | Chapman | 273/95 R |
| 3,239,227 | 3/1966 | Roope | 273/127 R |
| 3,393,913 | 7/1968 | Safina | 273/118 R |
| 3,580,578 | 5/1971 | McCarthy | 273/95 R |
| 3,643,950 | 2/1972 | Holk | 273/105 R |
| 3,741,544 | 6/1973 | Wolff | 273/123 R |

FOREIGN PATENT DOCUMENTS 781490 5/1935 France .

*Primary Examiner*—George J. Marlo
*Attorney, Agent, or Firm*—Arthur W. Fisher, III

[57] ABSTRACT

A target game wherein a ball or similar missile is tossed and rolled, in a bowling manner, over a horizontal surface toward a target element. The target element comprises side frames, a rear gate assembly, a top webbing and a scoring grid to provide a plurality of scoring sectors and may further include a ramp adjacent the target element in combination with wind up ribbons and cranks extending between at least two target elements. Each scoring sector may be identified by a number or a color. The target element is collapsible or foldable for storage and transport. Provisions for keeping score and for bonus scoring may be included. The game, in its mode of play, may be related to space travel, baseball, jackpot, bowling, lunar ball, or black jack by the designation of apparatus with appropriate names for targets and scoring sectors. Scoring may be measured in terms of various space-related or conventional point units, depending upon the type of game chosen for playing.

19 Claims, 10 Drawing Figures

TARGET GAME

BACKGROUND OF THE INVENTION

1. Field of the Invention

This invention relates to an improved indoor-outdoor game and more particularly to a lawn game in which two, three or more players roll a missile toward a target.

2. Description of the Prior Art

There are numerous target-type games in the field of art. These include games having a bulls-eye target at which an object is thrown as well as games having a face with apertures through which a ball or missile is thrown. Few such target games utilize the concept of a ball or missile which is to be tossed or rolled along a generally horizontal surface in a bowling-type fashion. In bowling-type games, the object is usually to strike pins or other elements with the ball or missile, rather than to cause the ball or missile to come to rest at a particular point or area.

Bowling-type games are generally popular, are playable by people of greatly varying ages and are easily understood and executed. There is a definite need for new forms of a game utilizing the concept of a thrown or rolled ball or missile. In addition, target-type games are similarly easily understood and well-received. The purpose of this invention is to meet the continuing need for improvement in games using the concept of a thrown ball or missile and a fixed target.

Specific prior art known to applicant include: U.S. Pat. Nos. 3,741,544; 1,248,970; 922,717; 1,329,291; 3,580,578; 3,393,913; 3,239,227; 1,072,954; 3,643,950; and France No. 781,490.

SUMMARY OF THE INVENTION

The invention relates to an improved target game wherein many different types of games may be played by tossing or rolling a ball or similar missile toward a target member.

The invention also relates to a rigid target element, foldable for storage and transport purposes, which is constructed and arranged for use on a generally horizontal supporting surface.

The target element consists of a plurality of scoring sectors, which may be in the shape of a square, trapezoid, triangle, circle, or combination thereof. Each sector is formed from a grid of base ribs which may be integrally formed with the target element. The horizontal side anchor bars position the side frames in a substantially parallel relation to each other. The rear of the target element is provided with a folding tail gate which serves as the ball or missile stop. This member also functions as a brace and as a ball carrier. Two or more balls or similar type missiles are used by the players in attempts to toss and roll the balls over the base ribs of the scoring grid of the target and into one of the plurality of scoring sectors.

The scoring grid may be provided with special sectors which could result in bonus points for the players whose balls come to rest therein, such as three certain sectors in a row, or sectors having specified numerical values, or sectors all of one color.

The target is designed to collapse or fold into a compact volume for ease in storing and transporting. When collapsed or folded, the target forms a container for carrying and storing the balls and a collapsible score card, rod and holder.

The target is merely laid on the ground or other horizontal surface and therefore may be easily moved from one location to another during use. The game may be played inside or outside on lawns or any other substantially flat surface. The surface requires no special preparation.

Flexible lines or ribbons are attached to the front of the sides of said target element and extended horizontally to define a lane for tossing or rolling a ball or other missile toward said target. Stake pins are provided to affix the lines or ribbons to an earth surface and adjust width of ball guide lane. Where more than one target is used by the players, the ball guide lines or ribbons of said target one are attached to the opposite target. Means are provided for winding said lines or ribbons on a spool using a crank.

Several games may be played using the same target and rolling missiles of this invention, depending on the rules adopted by the players. For example, the various scoring sectors of the scoring grid of the target may be designated with lunar and other space related names and scoring based on lunar and other space related measurements. To illustrate the foregoing, the target may be referred to as a space station, the scoring sectors may be named after planets and scoring points may be expressed in lunar miles.

As another example, a type of a baseball game may be played with the designated points of each sector referred to as runs, or a jackpot type game may be played, with the designated points referred to as dollars or pennies.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
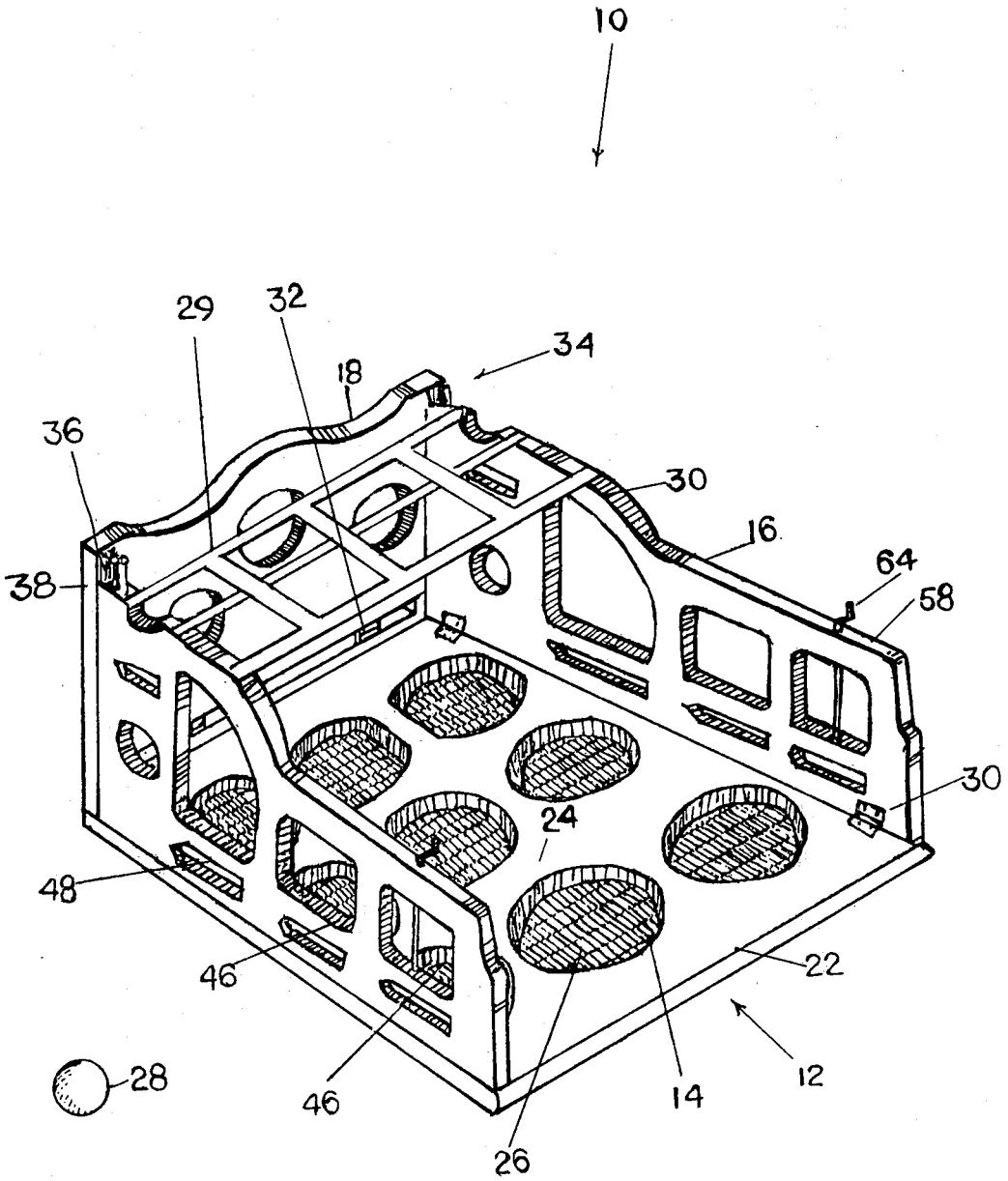
FIG. 1 is a perspective view of the collapsible target elements and missiles of this invention.

FIG. 1 shows the game apparatus of this invention generally indicated as 10. A partially enclosed collapsible target element 12 comprises a scoring grid 14, side frame members 16, rear gate assembly 18, and optional top web 20. The scoring grid 14 is defined by a plurality of longitudinal ribs 22 and latitudinal ribs 24 arranged to form a plurality of scoring sectors 26 at which rolling missile 28 is aimed by the players. Top web 20 comprises cord-like elements attached to one another and attached to the rear of side frame members 16 to form a barrier to aid in preventing the rolling ball or missile 28 from escaping from the target element 12.

Rib members 22 and 24 are integrally formed as a unit out of any suitable material such as wood, plastic, rubber or metal. As shown, the individual scoring sectors 26 may be formed to be circular shaped or other suitable shape.

Figure 2:
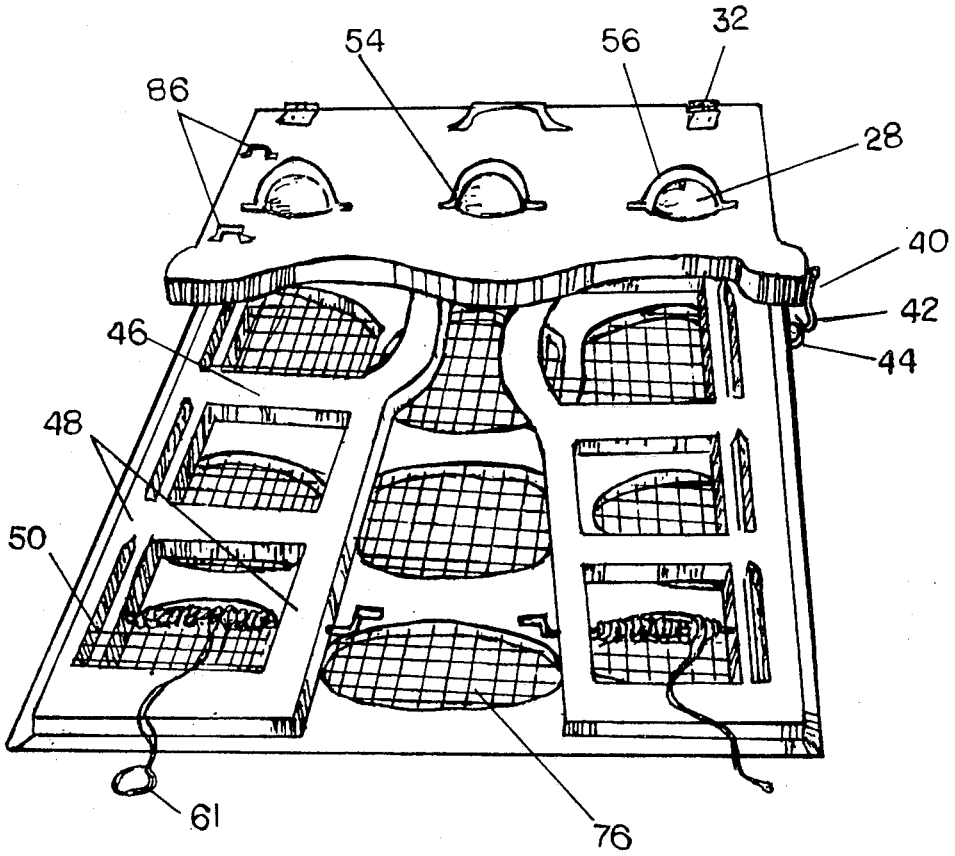
FIG. 2 is a perspective view of the collapsible target element in the collapsed position.
Figure 3:
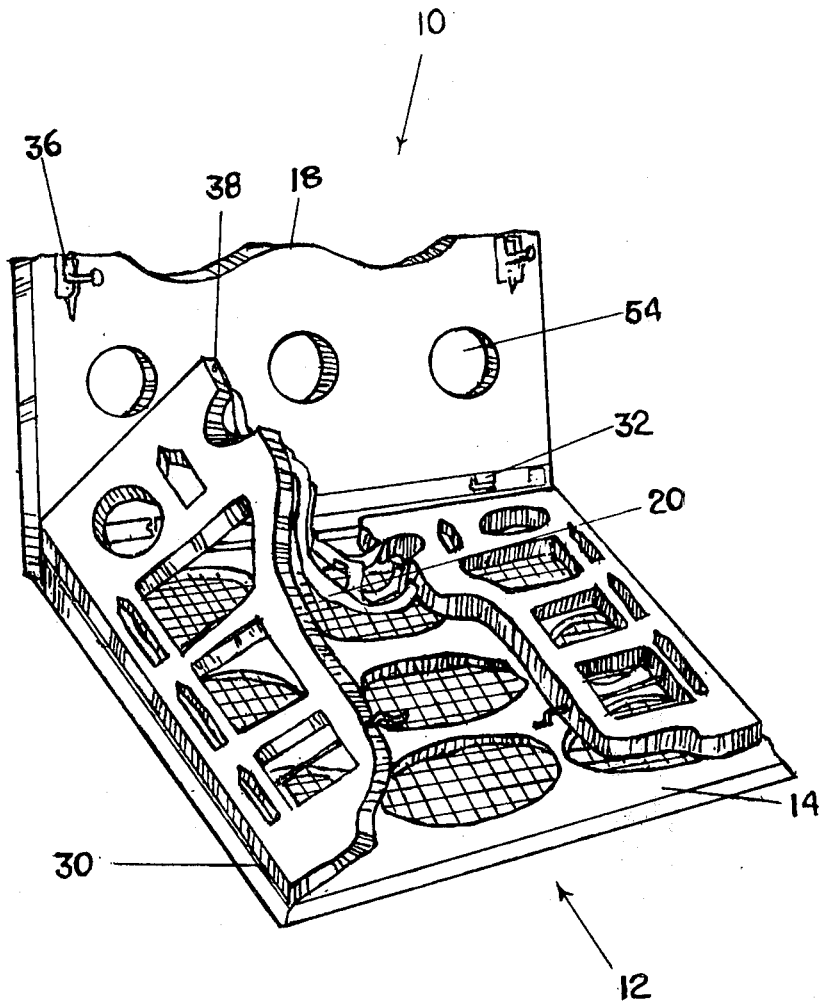
FIG. 3 is a perspective view of the collapsible target element in a partially collapsed position.

As best shown in FIG. 2, the target element 12 is uniquely structured to collapse for storage and carrying. As shown in FIGS. 1 and 2, side frame members 16 and rear gate assembly 18 are pivotally coupled to the scoring grid 14 by hinges 30 and 32 respectively. This permits movement of the side members 16 and rear gate assembly 18 between a first or open position as shown in FIG. 1 and a second or closed position as shown in FIG. 2. The target element 12 further includes a pair of first lock means 34 each comprising a first and second member 36 and 38 respectively attached to the tops of the side frame members 16 and rear gate assembly 18 respectively to cooperatively lock the target element 12 in the first or open position. A second lock means 40 comprises a first and second element 42 and 44 respectively attached to the sides of one side frame member 16 and rear gate assembly respectively to cooperatively lock the target element 12 in the second or closed position.

Side frame members 16 may be assembled from separate vertical posts 46, upper and lower beams 48 and horizontal bumper bars 50 or may be integrally formed as a unit out of any suitable material such as wood, plastic or aluminum. The side frame members 16 assist in retaining the missiles 28 on a more even course and aid in keeping missiles 28 within the target area.

The side frame members 16 and rear gate assembly 18 cooperatively form a retainer means to secure the missiles 28 thereto when the target element 22 is in the closed second position. The retainer means comprises a plurality of seats or apertures 52 formed in the inner portion of the side frame members 16 and a corresponding plurality of tops or apertures 54 formed on the rear gate assembly 18 to receive the missiles 28 therein. The retainer means further includes a corresponding plurality of semi-circular securing elements 56 extending across each aperture 54 to engage the periphery of the missiles 28 disposed therein.

Figure 4:
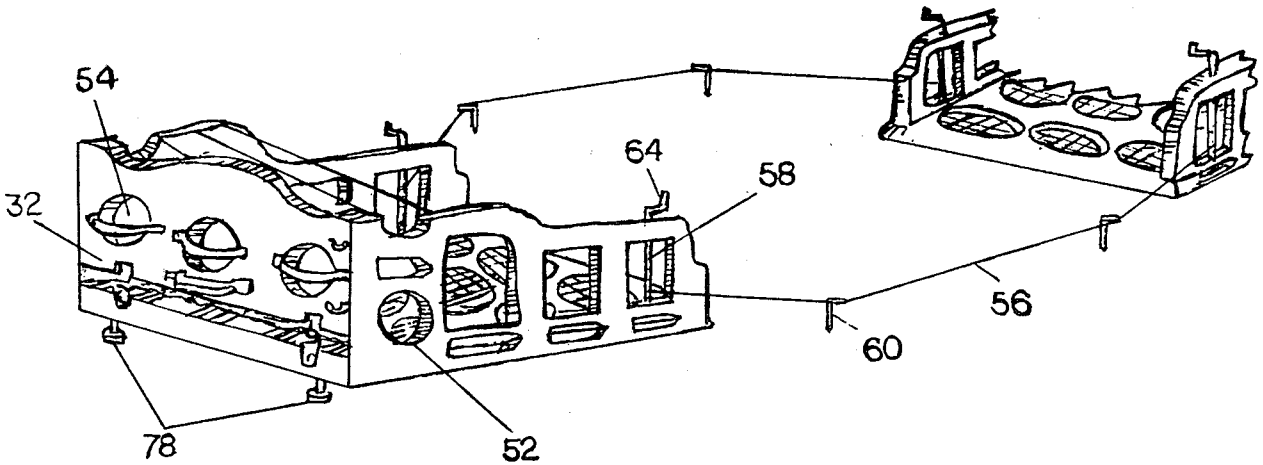
FIG. 4 is a view of the ball guide tape as used with two target elements.

FIG. 4 illustrates use of two target elements 12 with ribbons 56 attached thereto by means of pins 58 located near the front lower corners thereof, the ribbons 56 extending between said target elements 12 to form guidelines for tossing or rolling balls 28. Optional pins 60 may be used to position ribbons 56 to cause said guidelines to form a playing surface area which is wide at the place where balls 28 are thrown and which narrows near the target elements 12. It has been found that such a shape increases the ability of the players to guide balls 28 into the target element 12. Ribbons 56 and pins 60 may be used during game play with either one or two targets 12 to prescribe throwing distances, to anchor a target or targets 12 in place and to serve as penalty lines. Ribbons or lines 56 may have aperture, loop or a hook 61 at the outer ends to attach to pins 60 or opposite target 12.

Figure 5:
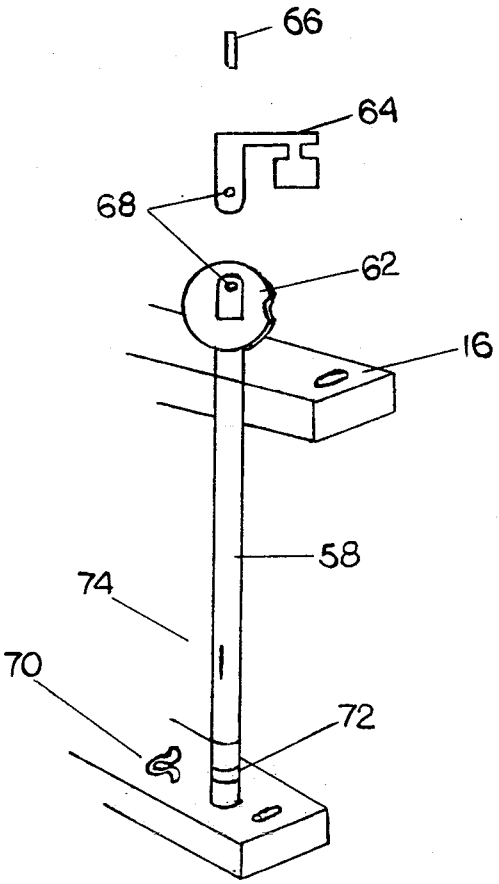
FIG. 5 is a perspective view of a spool for a ball guide tape indicating attachment and assembly.

Ribbons 56 may be stored separately and attached to target elements by means of pins 58 inserted through holes in the side frame members 16 and through appropriate holes in the ribbons 56. Pins 58 are provided with heads 62. As indicated in FIG. 5, ribbon 24 may alternatively be wound on pins 58 by means of crank 64 which is attached to a locking pin 66 inserted through holes 68 through both pin 58 and crank 64. Crank 64 may be used to lock or prevent rotation of pin 58. Locking clip 70 may be inserted in slot 72 of pin 58 to aid in holding pin 58 in vertical position. Slot 74 on pin 58 may be used to affix ribbon 56 to said pin.

While FIG. 4 indicates a two-target element 12 version of the game, it is understood that the game may be played with one target element 12 only.

The target 12 further includes a vertical adjustment type leg or screw attached 78 to opposite sides of the rear corners of the scoring grid 14 to vary the rear height of target 12.

By elevating the rear of the target, the scoring grid 14 is elevated from the rear of the scoring grid 14 to a lesser degree at the front of the grid 14 where the ball or missiles 28 enter the target area, thus making the target 12 more level and stable. If placed upon a surface not perfectly level such as the ground, it also acts to elevate scoring sectors 26 and grid 14 above grass or other small objects.

Mesh 76 is attached to the underside of scoring grid 14 with generally circular-shaped scoring sectors 26. The mesh 76 is preferably constructed of a semi-rigid material such as metal or plastic so the mesh 76 acts to form a definite depth or scoring zone of the scoring circles in the scoring grid 14 thus allowing each ball or missile 28 to pass over one scoring sector and into another scoring sector with limited resistance to require greater skill from the player. However, the mesh 76 in any row may alternately comprise a flexible mesh to form a pocket to trap and receive the balls 28. In addition the scoring zones form a uniform scoring grid 14 and act to level grass or other plant life.

Figure 6:
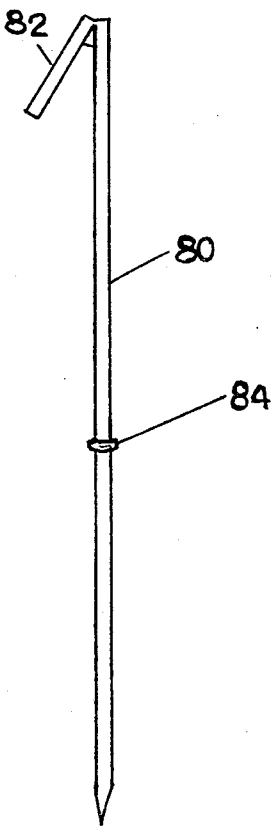
FIG. 6 is a detailed view of an adjustable score card.

FIG. 6 shows an adjustable or telescoping score card rod 80 and holder 82. Adjustment is made to the score card rod 80 by means of a locking screw. Rod 80 may be inserted in brackets 86 (FIG. 2) in the rear gate assembly 18 during use. Alternatively, rod 80 may be inserted in the ground. For storage or transport the score card rod 80 is closed to is smallest position and placed within the target 12 before folding.

The game is played by playing one or two targets 12 on a lawn or other reasonably flat surface. Two or more players may compete against each other. As in other games, an number of players may be divided into teams. Each player is given three balls 28 and each ball 28 is tossed and rolled toward the target 12 from a distance of ten to twenty feet, depending upon the age and skill of the player. The highest scoring sectors 26 are the sectors 26 of the target 12 nearest the player, and therefore the player attempts to cause the ball 28 to come to rest in those sectors. For example, a ball 28 at rest in the nearest sectors 26 may result in a score of either four, six, or five points, the next sectors either 5, 3 or 4 points, the next sectors either 2, 1 or 2 points. In one version of the game, the players may alternate turns and attempt to knock the balls 28 of previous players into lower scoring sectors 26. Where many players are playing, the ball 28 may be removed after each player has rolled three consecutive balls 28 depending on the type of game being played.

In the course of playing any one of the games provided for on the target 12, special bonus points may be awarded to the player whose three balls 28 come to rest in designated scoring sectors 26. As an example, three balls 28 that come to rest in a horizontal row or a vertical row or three scoring sections of the same color would lead to designated bonus points.

Figure 7:
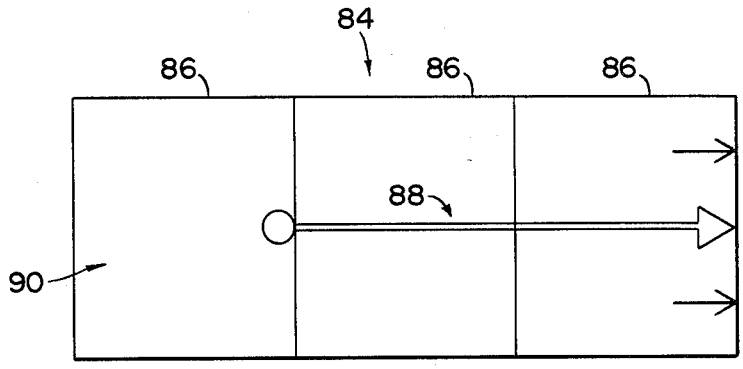
FIG. 7 is a top view of a ball guide pad.
Figure 8:
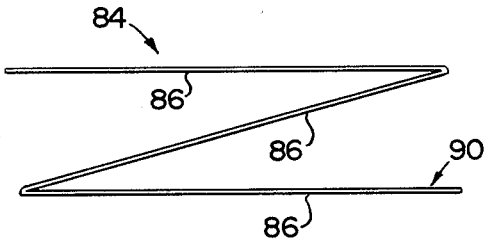
FIG. 8 is a side view of the ball guide pad partially folded.

As shown in FIG. 7, a ball guide pad 84 comprises three sections each indicated as 86 may be placed immediately adjacent each target element 12 forward of the scoring grid 14. A plurality of guide markings 88 are formed on the upper surface 90 of the ball guide pad 84. These guide markings 88 may form indentations which service to direct the missiles 28 to particular scoring sectors 26. The ball guide pad 84 constructed of rubber, artificial turf or the like provides a substantially even playing surface which cushions the missile 28 as it approaches the target elements 12. As shown in FIG. 8, the three sections 86 may be folded for storage between the side frame members 16 and scoring grid 14 when collapsed.

Figure 9:
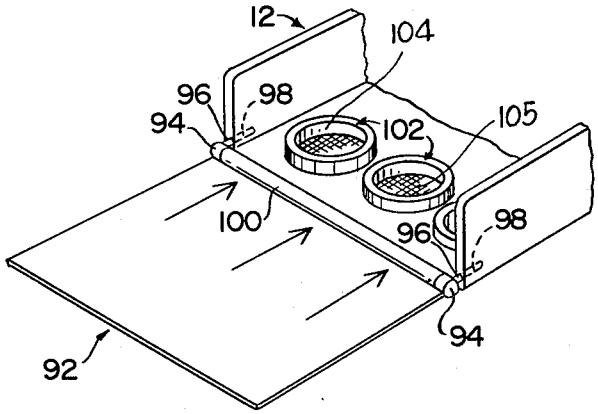
FIG. 9 is a perspective view of an alternate target game.

FIG. 9 shows an alternate embodiment of the game apparatus 10 further including a target ramp comprising a diagonally disposed surface or ramp generally indicated as 92 having a pair of interlocking end tabs 94 formed on opposite sides thereof. Extending downwardly therefrom is the pair of pins 96 to operatively engage eyelets or interconnecting or lock means 98 on the forward portion of the target 12 to operatively interlock the surface 92 to the target 12. Disposed along the inner portion of the inclined surface 92 is a substantially resilient bumper 100. In addition a plurality of scoring targets each generally indicated at 102 are provided to operatively mount within scoring sectors 26. More particularly the target 102 comprises enlarged upper ring 104 and a lower reduced annular body 105 configured to receive the missiles 28 as more fully described herein. Specifically the ball may be rolled up the inclined plane or surface 92 to engage bumper 100 and dependent upon the velocity and direction of the rolling missile 28 the various scoring sectors 102 will capture the missile 28 determining the score to be awarded the player. As can be seen the skill would be required as the various scoring targets 102 may be assigned different values.

Figure 10:
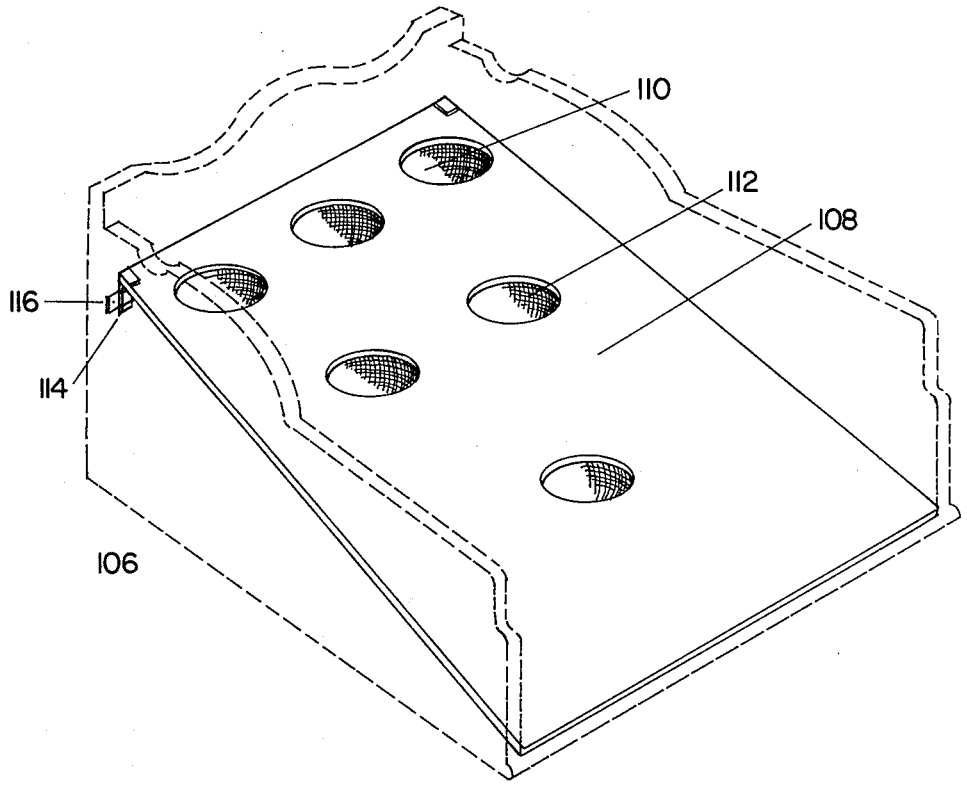
FIG. 10 is a perspective view of an alternate collapsible target element.

FIG. 10 shows an alternate embodiment wherein the scoring grid 106 is disposed diagonally upward from the forward portion of the target element. The scoring grid 106 comprises element 108 having scoring sectors 110 formed therein. Mesh 112 is attached to the underside of the element 108 to capture the missiles 28 as previously described. The scoring grid 106 is coupled to the rear gate assembly 18 by means of first and second coupling elements 114 and 116. Of course, the scoring grid 106 may be an additional element to the substantially horizontal scoring grid.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A target game comprised of ball missiles and a target element divided into a plurality of scoring sectors; a mesh attached to the underside of said scoring sectors; side frame members movable between an open and closed position attached to opposite sides of said scoring sectors a rear gate assembly movable between an open and closed position attached to the rear of said plurality of scoring sectors; and a first lock means to secure said side frame members to said rear gate assembly when said side frame members and said rear gate assembly are in said open position, said side frame members and said rear gate assembly cooperatively forming a retainer means to secure said ball missiles therein when said side frame members and said rear gate assembly are in said closed position, said retainer means comprises a plurality of apertures formed in said side frame members to form a seat to receive the lower portion of said ball missiles and a corresponding plurality of apertures formed in said rear gate assembly to receive the mid-portion of said ball missiles when in said closed position.

2. The target game of claim 1 wherein said first lock means comprises a first element attached to said rear gate assembly and a second element attached to one of said side frame members, said first and second elements disposed relative to each other to operatively engage each other when in said open position.

3. The target game of claim 1 further including a second lock means to secure said side frame members to said rear gate assembly when said side frame members and said rear gate assembly are in said closed position.

4. The target game of claim 3 wherein said second lock means comprises a first element attached to said rear gate assembly and a second element attached to one of said side frame members, said first and second elements disposed relative to each other to operatively engage each other when in said closed position.

5. The target game of claim 1 wherein said retainer means further includes a corresponding plurality of securing elements extending across each said aperture of said rear gate assembly to engage the periphery of said ball-like missiles disposed therein.

6. The target game of claim 1 further including a vertical adjustment means formed at the rear portion of said plurality of scoring sectors to selectively adjust the vertical height of the rear portion of said target game.

7. The target game of claim 1 wherein said mesh and said scoring sectors cooperatively form a corresponding plurality of scoring zones of a predetermined depth.

8. The target game of claim 7 wherein said plurality of scoring zones form a uniform scoring grid.

9. The target game of claim 7 wherein said mesh comprises a semi-rigid mesh.

10. The target game of claim 7 wherein said mesh comprises a flexible mesh to form pockets to receive said ball missles.

11. The target game of claim 7 wherein said scoring sectors comprise at least two rows.

12. The target game of claim 11 wherein said mesh comprises a semi-rigid mesh on at least one of said rows.

13. The target game of claim 1 further including ribbons attached to the lower front of each said side frame members and extending outwardly therefrom, each said ribbon being attached to a pin extending through said upper and lower beams of each said side frame member and a crack coupled to the upper end of each said pin.

14. The target game of claim 13 in which said ribbons extending outwardly from said side members are positioned by stake pins.

15. The target game of claim 1 further including a ball guide pad disposed immediately adjacent said plurality of scoring sectors, said ball guide pad comprising at least one section having at least one guide marking formed on the upper surface thereof, said guide marking forming an indentation to control the direction of said ball missile.

16. The target game of claim 1 further including a diagonally disposed ramp selectively coupled to a forward portion of the target element.

17. The target game of claim 16 wherein the diagonally disposed ramp further includes a resilient bumper disposed along the inner portion thereof.

18. The target game of claim 16 further including at least one target configured to be disposed in at least one of said scoring sectors.

19. The target game of claim 18 wherein said target comprises an enlarged open ring having lower reduced angular body extending downwardly therefrom to seat in said scoring sectors to receive said ball missiles.

* * * * *